US007013799B2

(12) United States Patent
Hendrix

(10) Patent No.: US 7,013,799 B2
(45) Date of Patent: Mar. 21, 2006

(54) CALENDER

(75) Inventor: Gottfried Hendrix, Wesel (DE)

(73) Assignee: Voith Paper Patent GmbH, Heidenheim (DE)

( * ) Notice: Subject to any disclaimer, the term of this patent is extended or adjusted under 35 U.S.C. 154(b) by 248 days.

(21) Appl. No.: 10/341,388

(22) Filed: Jan. 14, 2003

(65) Prior Publication Data

US 2003/0131738 A1 Jul. 17, 2003

(30) Foreign Application Priority Data

Jan. 16, 2002 (DE) ..... 102 01 349

(51) Int. Cl.
*B30B 3/04* (2006.01)

(52) U.S. Cl. ..... 100/161; 100/349

(58) Field of Classification Search ..... 100/161, 100/172, 175, 176, 331, 349
See application file for complete search history.

(56) References Cited

U.S. PATENT DOCUMENTS

| | | | | |
|---|---|---|---|---|
| 2,807,096 | A * | 9/1957 | Kullgren et al. | 34/543 |
| 3,488,142 | A * | 1/1970 | Cooper | 422/118 |
| 3,544,118 | A * | 12/1970 | Laine | 100/163 A |
| 4,658,716 | A * | 4/1987 | Boissevain | 100/38 |
| 5,058,496 | A * | 10/1991 | Wittkopf | 100/35 |
| 5,619,807 | A * | 4/1997 | Conrad | 34/414 |
| 5,651,863 | A * | 7/1997 | Van Haag et al. | 162/207 |
| 5,738,007 | A * | 4/1998 | Roerig et al. | 100/327 |
| 6,030,327 | A * | 2/2000 | Suomalainen et al. | 492/47 |
| 6,336,398 | B1 * | 1/2002 | Kayser et al. | 100/164 |
| 6,627,026 | B1 * | 9/2003 | Andersson et al. | 156/168 |
| 6,786,144 | B1 * | 9/2004 | Williams | 100/168 |
| 2004/0029663 | A1 | 2/2004 | Venetjoki et al. | |

FOREIGN PATENT DOCUMENTS

| | | |
|---|---|---|
| DE | 4412625 | 10/1995 |
| DE | 19944089 C1 * | 11/2000 |
| FI | 4757 | 12/2000 |
| WO | WO02/35140 | 5/2002 |

* cited by examiner

*Primary Examiner*—Derris H. Banks
*Assistant Examiner*—Jimmy T. Nguyen
(74) *Attorney, Agent, or Firm*—Greenblum & Bernstein, P.L.C.

(57) ABSTRACT

Calender that includes at least one supporting bracket, and a roll stack having at least two rolls. At least one axial end of each of the at least two rolls are supported by the at least one supporting bracket. A connection arrangement includes a fluid connection coupled to at least one of the at least two rolls and a drive connection coupled to at least one of the at least two rolls, and a closed housing is arranged to enclose the connection arrangement. The instant abstract is neither intended to define the invention disclosed in this specification nor intended to limit the scope of the invention in any way.

26 Claims, 6 Drawing Sheets

CALENDER

CROSS-REFERENCE TO RELATED APPLICATIONS

The present application claims priority under 35 U.S.C. §119 of German Patent Application No. 102 01 349.7, filed on Jan. 16, 2002, the disclosure of which is expressly incorporated by reference herein in its entirety.

BACKGROUND OF THE INVENTION

1. Field of the Invention

The present invention relates to a calender with a roll stack of at least two rolls that are supported in brackets in the area of their axial ends and with a connection arrangement such that at least one roll has a fluid connection and at least one roll has a drive connection.

2. Discussion of Background Information

Such a calender is used to glaze a material web, e.g., a paper web. To this end the material web is guided through at least one nip that is formed by two neighboring rolls that are pressed against one another. With a roll stack featuring more than two rolls, there is a correspondingly higher number of nips in which the material web can be acted on.

At least one of the rolls is driven. In modern Janus-type calendars, all the rolls can be driven. The drive of the at least one roll is provided via a face of the roll, i.e., a drive connection is provided in one of the two brackets. This drive connection can feature, e.g., an electric or hydraulic motor that is connected to the roll directly or via a gear unit. As a rule at least the end rolls are embodied as sag compensation rolls. In a sag compensation roll, the roll jacket is supported on a yoke or carrier via hydraulically greased support shoes. A constant feed of hydraulic fluid is necessary here. Lubricating oil must be constantly supplied to the antifriction bearings of the rolls. To improve the surface properties of a paper web, it is customary to heat at least one roll in the roll stack. To this end, a widespread approach is to feed a heat transfer medium, e.g., a hot liquid like water or oil, or steam into the roll. A fluid connection is necessary for the supply of hydraulic fluid, for the supply of lubricating liquid or for the supply of the heat transfer medium, which fluid connection is also arranged in the area of one or even both of the brackets. Such a fluid connection can feature, e.g., a rotary transmission with which it is possible to transfer a fluid from the stationary bracket to the rotating roll.

The danger of damage to components of the calendars increases with calendars operating more and more quickly. For instance, lines can break or bearings can be damaged. This can lead to dangerous situations.

SUMMARY OF THE INVENTION

The present invention increases safety during the calendering operation.

In this regard, the invention includes a calender of the type generally discussed at the outset in which the connection arrangement is arranged in an area that is enclosed by a closed housing.

Although this arrangement does not rule out the possibility of damage occurring to the calender, the impact of such damage can be kept to a minimum. In this regard, in the event of machine damage in the area of the connection arrangement, there is an increased danger of accidents and fire, e.g., due to splashing oil that can ignite and then burn or due to components flying about, e.g., when a rotary transmission is damaged. Such damage can cause considerable secondary damage in the area around the calender, e.g., to the paper machine, to the switchboard galleries, to the crane or even to people who are in the hall in which the calender is also located. The consequences of the damage caused by damage to the calender can be a multiple in economic terms of the damage to the calender. Under certain circumstances they can even jeopardize the existence of the paper factory if other important machines, e.g., the paper machine, break down in addition to the calender.

Through the housing it is ensured that the consequences of the damage are limited to a relatively narrowly enclosed area. In the event of damage to the calender, no other machines or parts in the factory are damaged as a result. It is therefore ensured that operability is rapidly restored. Above all, the danger to people is reduced. Moreover, there is an economic advantage in the event of fires. The housing forms its own fire area that is separate from the hall. This has a favorable effect on insurance premiums. Secondary damage to the calender itself is also reduced. Damage occurring in the housing has no or only comparatively slight impact on the roll surfaces that as a rule exhibit a certain sensitivity.

The bracket preferably forms a part of the housing. For mechanical reasons the bracket has to feature a certain stability. It therefore forms a partition wall that is very effective in mechanical terms between the connection arrangement and the actual working areas of the rolls, so that the rolls are protected from secondary damage in the event of damage occurring to the connection arrangement. The stable bracket gives the entire housing itself a certain stability, so that the other walls of the housing can be embodied in a cost-effective way. These walls need only to be able to prevent parts flying about from escaping outside and, if necessary, to provide a certain resistance to a fire.

The area preferably features an extinguishing agent feed. In the event that a fire occurs, a means is provided with the extinguishing agent feed to extinguish the fire relatively quickly. The extinguishing agent can be adapted to the special application case. It can be, e.g., $CO_2$ or an extinguishing foam, i.e., extinguishing agents whose harmful impact on the connection arrangement can be kept to a minimum.

The roll stack is preferably tilted relative to the gravitational direction and the housing features a correspondingly tilted cover that serves as the basis for a step arrangement. The housing is therefore used for a second purpose, i.e., to facilitate access to the rolls. This type of access is useful, e.g., when an operator wants to carry out maintenance work or wants to insert a material web in the nip(s) of the roll stack.

The cover is preferably displaceable. Access to the connection arrangement is thus provided from above, which is useful particularly when components of the connection arrangement are to be handled by the hall crane.

It is particularly preferable here for the cover to be displaceable in the axial direction of the rolls. Sliding the cover can normally be accomplished with less force than is required to lift it up. Handling is therefore facilitated.

It is hereby preferred for the cover to be supported on rails. On the one hand the rails provide a way of guiding the cover so that it can be kept precisely in position. Moreover, the rails also form a sliding or rolling surface that makes it easier to move the cover.

The rails are preferably arranged outside the cross section of the roll stack and extend over the width of the calender. The cover can thus be moved over the rolls, thus using the cover at the same time as a working platform to carry out inspection or maintenance work on the rolls or to thread the material web into the nips. Since the rails are arranged outside the cross section of the roll stack, they do not obstruct the operation of the calender and in addition also permit free access to all the rolls from above. Handling the rolls with the hall crane is thus not obstructed.

The cover preferably features a sealing arrangement to the rest of the housing. This sealing arrangement seals off the cover to the housing. Since the cover is to be moveable with regard to the housing, it is virtually impossible to fit the cover to the housing such that no gaps occur. The sealing arrangement is now able to seal off such gaps so that, e.g., the danger of flames getting out is kept to a minimum. The danger is also reduced of parts flying about being hurled out through a gap between the housing and the cover.

The sealing arrangement preferably features a seal that can be pressurized. The pressure on the seal can be released when the cover is to be moved, and pressurized when the seal arrangement is to seal off the cover relative to the housing. This is a relatively simple measure to make it possible to open the cover.

At least some center rolls of the roll stack are preferably supported on levers and protective cushions are arranged between neighboring levers. These protective cushions can modulate the scattering of parts when such parts are detached in the area of the levers. Particularly in the area of the levers, where the distances between the location of damage and a possible location of secondary damage are short, the protective cushions are a very effective instrument for reducing or even completely avoiding secondary damage.

It is particularly preferred here for the protective cushions to fill an area between levers. This can be done, e.g., by the protective cushions being inflatable, i.e., that they can be pressurized. However, it is also possible to use preformed elements that can still be shaped and to place them between the levers. When there is no space between the levers, it prevents the detachment of parts.

The present invention is directed to a calender that includes at least one supporting bracket, and a roll stack having at least two rolls. At least one axial end of each of the at least two rolls are supported by the at least one supporting bracket. A connection arrangement includes a fluid connection coupled to at least one of the at least two rolls and a drive connection coupled to at least one of the at least two rolls, and a closed housing is arranged to enclose the connection arrangement.

According to a feature of the present invention, the closed housing can include the at least one supporting bracket.

Further, an extinguishing agent feed may be arranged within the closed housing within a region of the connection arrangement.

The roll stack can be oriented to be tilted relative to the gravitational direction. Moreover, the closed housing may include a cover tilted at an angle that corresponds to the tilt of the roll stack, and the cover can include a step arrangement. The cover can be displaceable from the closed housing to thereby open the closed housing. Still further, the cover may be displaceable in an axial direction of the at least two rolls. The calender can further include rails, such that the cover is displaceably supported on the rails. The rails are arranged outside a cross section of the roll stack and can extend over a width of the calender. A sealing arrangement may be coupled to the cover, whereby, when closed, the closed housing can be sealed, and the sealing arrangement can include a pressurizable seal.

According to another feature of the invention, the at least two rolls can include at least two end rolls and a plurality of center rolls arranged between the at least two end rolls, and the plurality of center rolls can be supported on levers. Protective cushions can be arranged between neighboring levers. The protective cushions may fill an area between neighboring levers.

The present invention is directed to a calender that includes a roll stack having a plurality of rolls and a closed housing arranged at at least one axial end of the plurality of rolls to enclose at least a portion of the plurality of rolls.

In accordance with a feature of the invention, the closed housing can include a support bracket arranged to support the at least one axial end of the plurality of rolls. The at least a portion of the plurality of rolls may include roll bearings on the at least one axial end of the plurality of rolls. The at least a portion of the plurality of rolls may include at least one of a drive connection coupled to one of the plurality of rolls and a fluid connection coupled to one of the plurality of rolls. Further, the closed housing may include a displaceable cover, and rails can be arranged parallel to the rolls, such that the cover is axially displaceably supported on the rails. The rails may extend over a width of the calender, and the cover may be sealingly couplable to the housing through a pressurizable seal.

According to another feature of the invention, the at least two rolls can include at least two end rolls and a plurality of center rolls arranged between the at least two end rolls, and the plurality of center rolls may be supported on levers. Further, protective cushions can be arranged between neighboring levers, and the protective cushions may fill an area between neighboring levers.

In accordance with still yet another feature of the present invention, the plurality of rolls are two rolls arranged to form a single nip.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
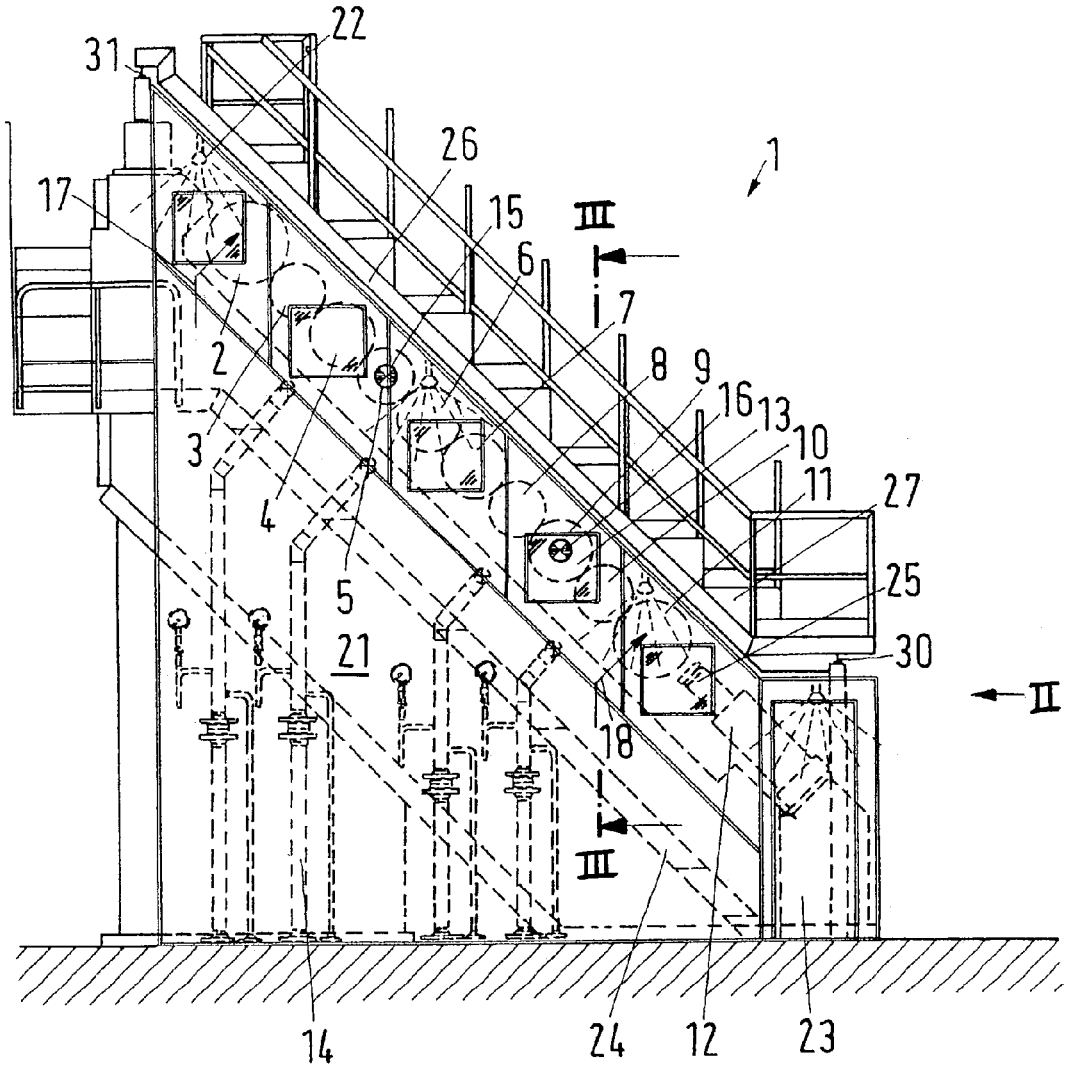
FIG. 1 illustrates a diagrammatic side view of a calender.
Figure 2:
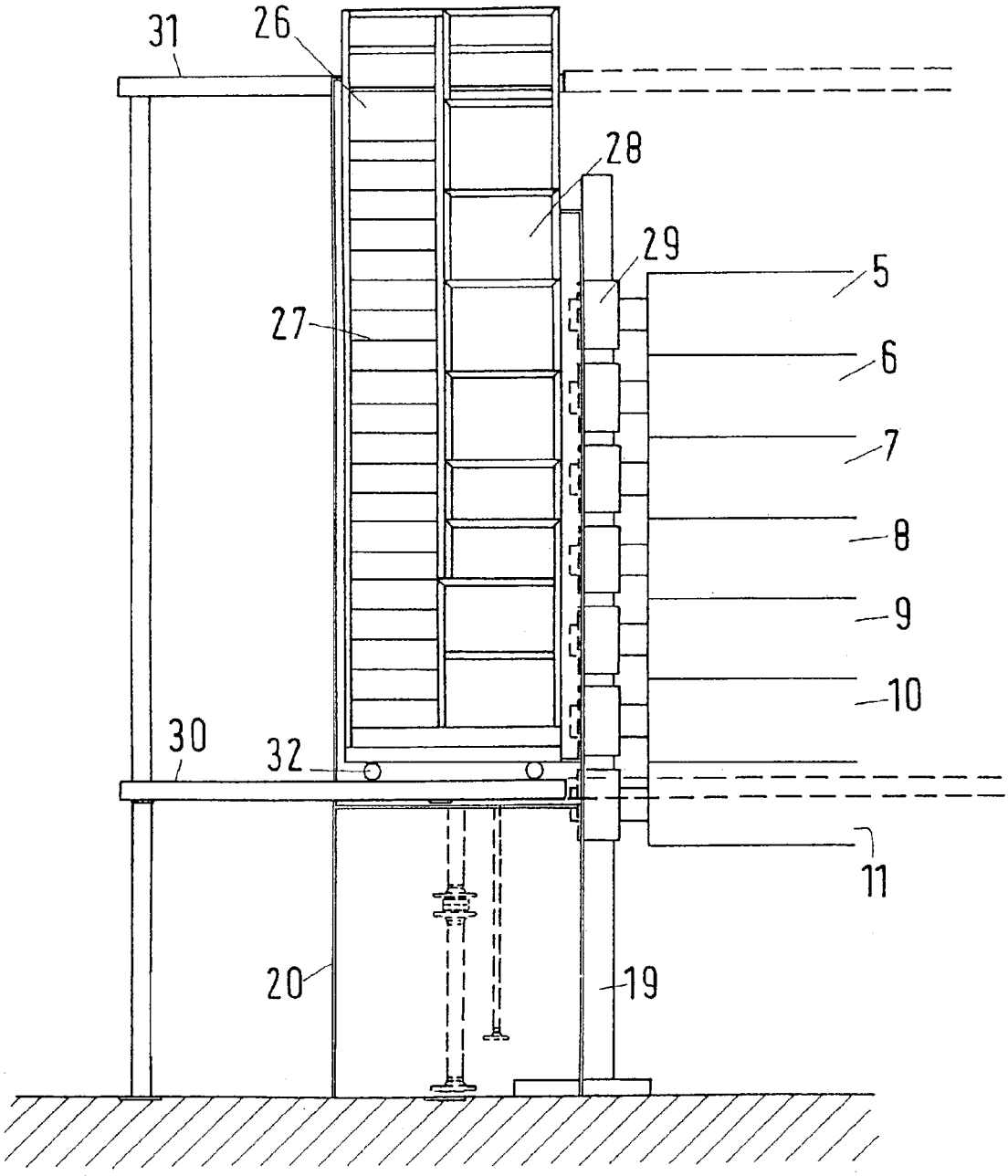
FIG. 2 illustrates a view from the perspective of position II depicted in FIG. 1.

A calender 1 according to FIGS. 1–5 features a roll stack with a plurality of rolls, e.g., rolls 2–11. In FIG. 2, upper three rolls 2–4 are dismantled for ease of illustration. The roll stack is tilted at an angle of about 45° to the horizontal. In a manner known per se, top end roll 2 and bottom end roll 11 are embodied as sag compensation rolls, and bottom end roll 11 is acted on with a force in a press plane 13 by a piston-cylinder arrangement 12. The axes of virtually all the rolls 2–11 lie in press plane 13.

Rolls 4, 6, 8, and 10 are embodied as heated rolls, to which a heating medium, e.g., hot water, hot oil, or steam, is supplied via lines 14. Lines 14 are connected to rolls 4, 6, 8, and 10 by rotary transmissions (not shown). Rolls 5 and 9 feature drives 15 and 16 that are embodied, e.g., as electric or hydraulic motors. Naturally, other or even all the rolls can also be driven. Top roll 2 and bottom roll 11 are provided with hydraulic connections 17 and 18, which are represented here merely by arrows for reasons of clarity. Hydraulic fluid is fed under pressure via hydraulic connections 17 and 18. Top roll 2 and bottom roll 11 are embodied as sag compensation rolls, in which the roll jacket is supported on a carrier via support shoes. The contact surface between the support shoes and the roll jacket is constantly lubricated with the hydraulic fluid.

A connection arrangement is formed by the rotary transmissions through which the heating liquid is supplied from lines 14, by drives 15 and 16, and/or by connections 17 and 18 and the connection arrangement is exposed to the risk of damage. This applies in particular when calender 1 is more highly stressed, e.g., when it is running at a relatively high operating speed.

The rolls are supported in a bracket 19 that (cf. FIG. 2) forms a wall of a housing 20. Housing 20 encloses an area 21 in which the connections (the above-mentioned connection arrangement) are arranged, i.e., the fluid connections to lines 14, the drive connections to drives 15 and 16, and hydraulic connections 17 and 18. The housing is closed on all sides. When parts of the rotary transmissions are detached during operation, they cannot cause any great damage outside the calender 1 even at a higher speed, because they are kept within housing 20.

Figure 3:
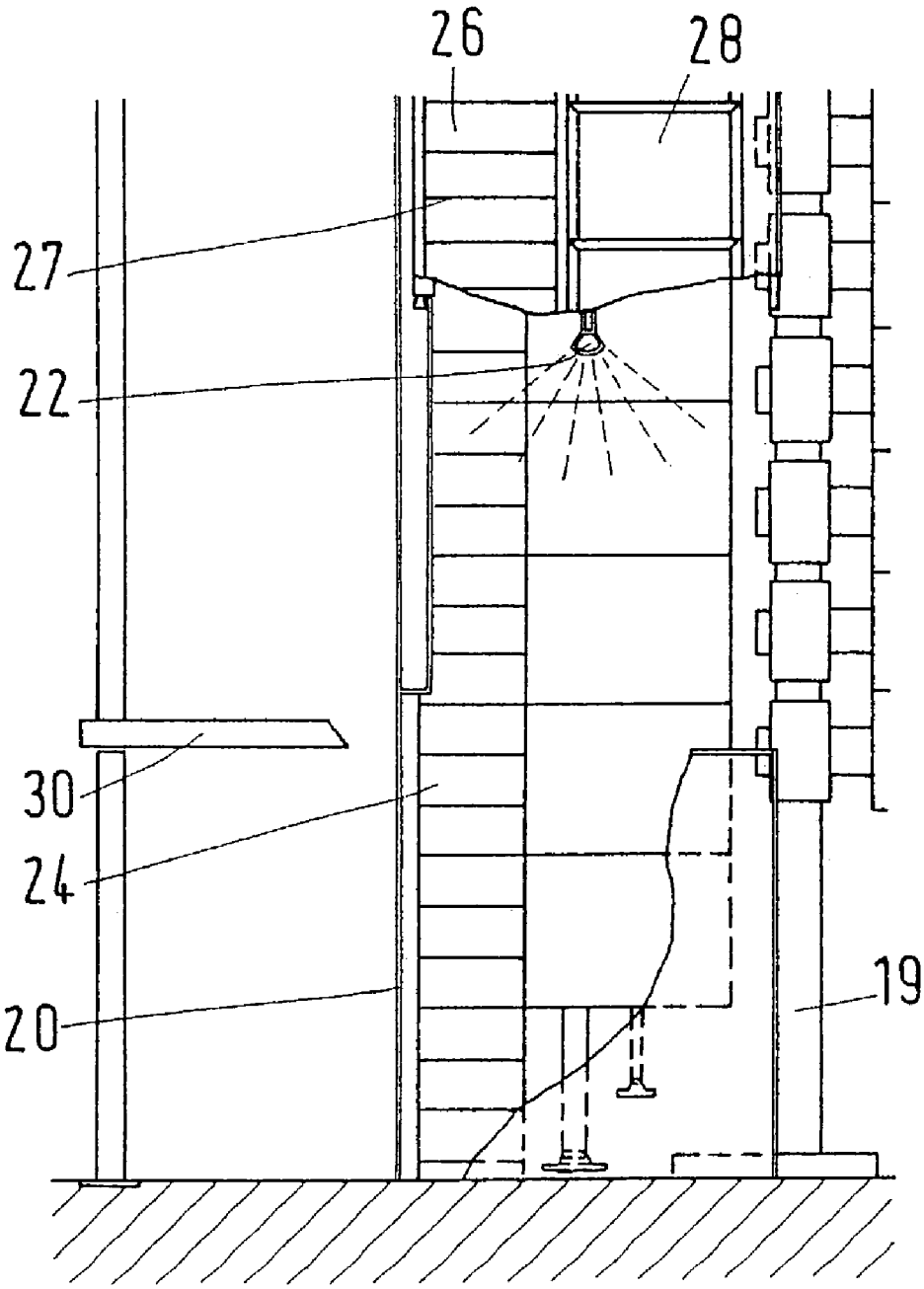
FIG. 3 illustrates a sectional cut-away view III—III as depicted in FIG. 1.

Extinguishing agent feeds 22 are also provided in housing 20, through which feeds an extinguishing agent, e.g., an extinguishing foam or a gas, such as carbon dioxide ($CO_2$), can be fed into the area 21 when a fire is detected in the area. For ease of illustrations and explanation, FIG. 3 shows a cut-away sectional view along line III—III depicted in FIG. 1 that illustrates one of the agent feeds 22 within housing 20.

A door 23 is provided in housing 20 in order to provide an operator with access to area 21. Steps 24 are arranged in area 21 that a user can walk on to obtain access to all the connection arrangements. Furthermore, window openings are provided in the side wall of housing 20, through which an optical monitoring of the connection arrangement is possible from outside. Window openings 25 are closed by panes, preferably made of, e.g., a non-combustible and very impact-proof plastic.

Housing 20 is closed at the top by a cover 26, on which a step 27 is arranged. Working platforms 28, see, e.g., FIG. 2, are embodied at the side next to steps 27, and each working platforms is assigned to one of rolls 2–11. An operator can thus access working platform 28 by steps 27 and from there reach bearings 29 of the rolls which, as already mentioned, are supported in brackets 19.

A cover 26 can be moved on rails 30 and 31. To this end, cover 26 can be provided with casters 32. Rails 30 and 31 can be arranged to extend essentially parallel to the axes of rolls 2–11, and are arranged outside the cross section of the roll stack. In this manner, between rails 30 and 31, there is access to all the rolls from above, so that rolls 2–11 can be handled by a hall crane without conflicting with rails 30 and 31. It is therefore possible, as shown by dotted lines in FIG. 2, to extend rails 30 and 31 over the entire width of the calender, so that cover 26 can be moved crosswise over calender 1 in order to obtain access to rolls 2–11 also in the area of their working width. This can be useful, e.g., when a material web is to be inserted between the nips formed between rolls 2–11.

If only access to area 21 is required, cover 26 can be moved away from the roll stack, i.e., outwardly (to the left in FIG. 2).

Figure 4:
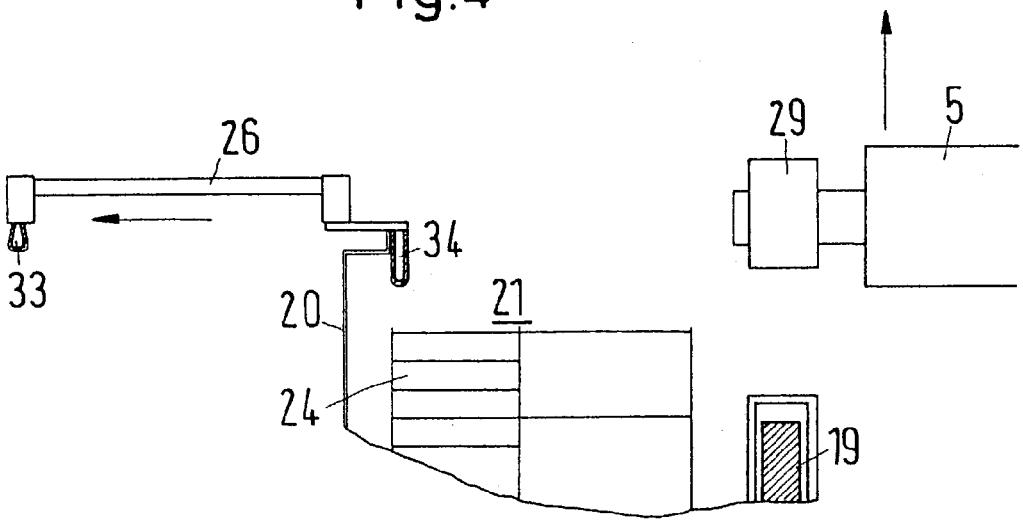
FIG. 4 illustrates a partial view of the view depicted in FIG. 2.

As illustrated in FIG. 4, on the underside cover 26, seals 33 and 34 are embodied as hoses and form a sealing arrangement. When cover 26 is arranged in its closed position on housing 20, seals 33 and 34 can be pressurized in order to create a seal between cover 26 and housing 20. It is not necessary here for the seal between cover 26 and housing 20 to be hermetically sealed. It needs only to prevent flames from getting out into the open from area 21 and parts flying around in area 21 from reaching the outside.

When cover 26, as shown in FIG. 4, has been moved in order to open area 21, bearings 29 of bracket 19 can be detached and a roll 5 can be transported upwards, e.g., with the aid of a hall crane (not shown).

Figure 5:
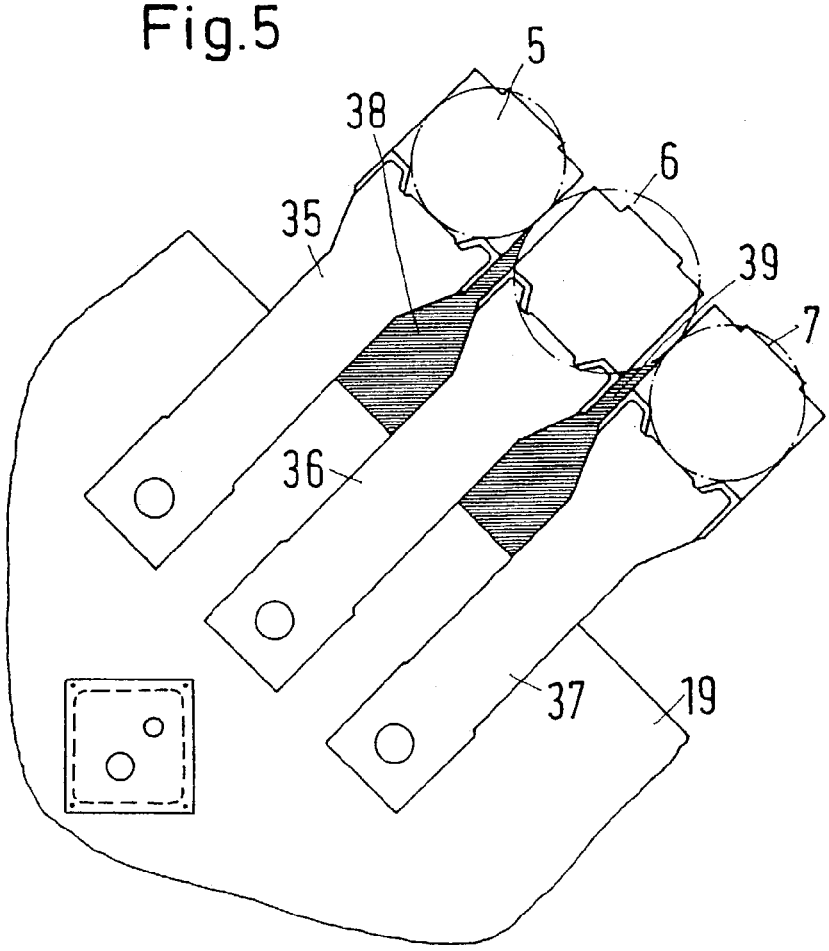
FIG. 5 illustrates detailed view of guide bearings.

As FIG. 5 shows, at least center rolls 5–7 are supported on levers 35, 36, and 37 in bracket 19. As a rule, all intermediary rolls 3–10 are supported on such levers.

Protective cushions 38 and 39 are arranged between levers 35 and 36, or 36 and 37, which protective cushions are inflatable or made of a workable plastic, e.g., a foam rubber. Protective cushions 38 and 39 have several purposes, e.g., they fill the area between levers 35–37. If parts of rolls 5–7 are detached in the area of the bearings during operation, such parts are prevented from flying away by protective cushions 38 and 39. Moreover, if they are fitted with a certain amount of pressure, which can be slight, between levers 35–37, they also act as damping elements against vibrations of levers 35–37. The vibration damping is another safety aspect, because less damage can be expected with a lower vibration.

Figure 6:
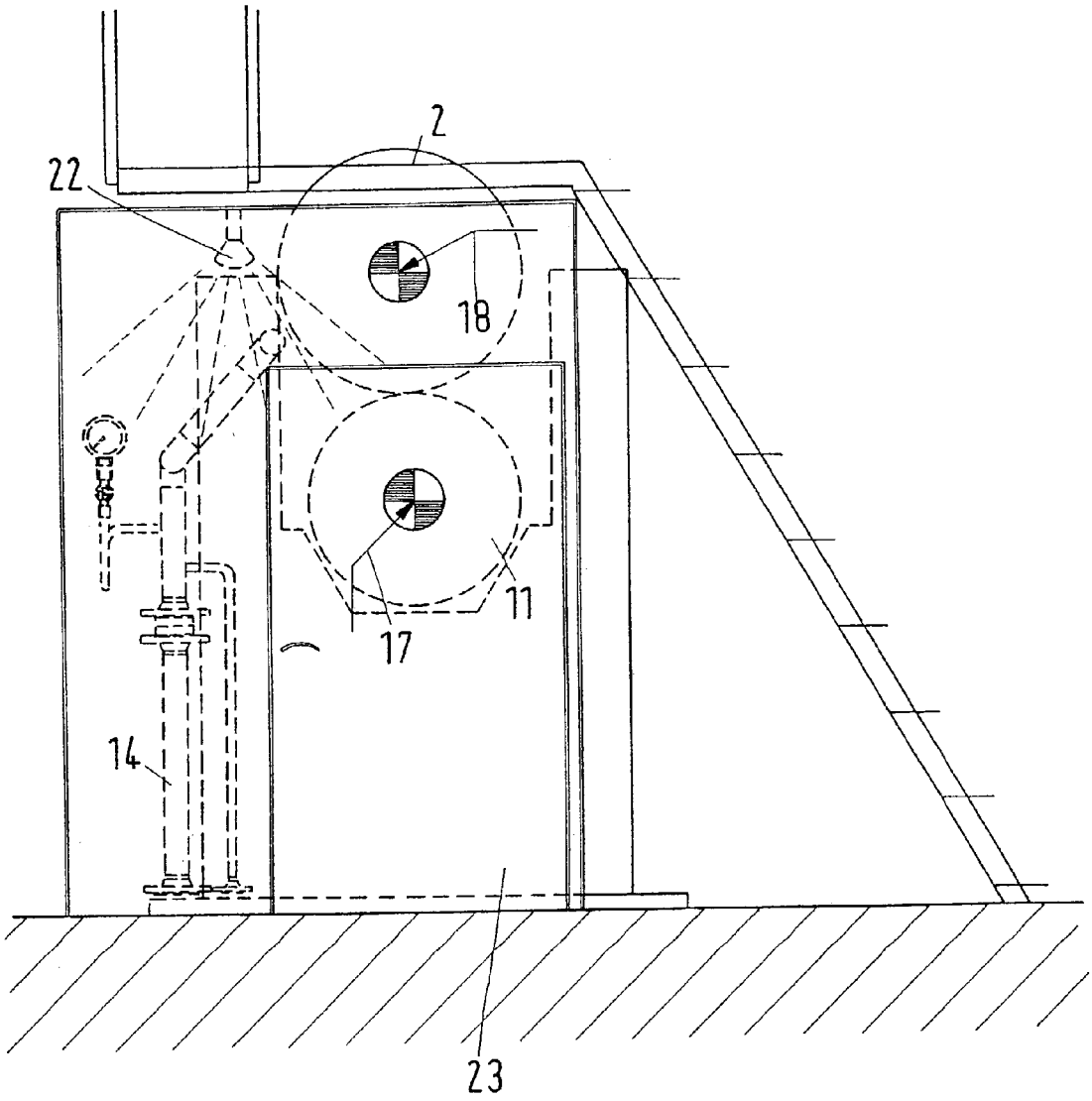
FIG. 6 illustrates a diagrammatic side view of a two roll calender.
Figure 7:
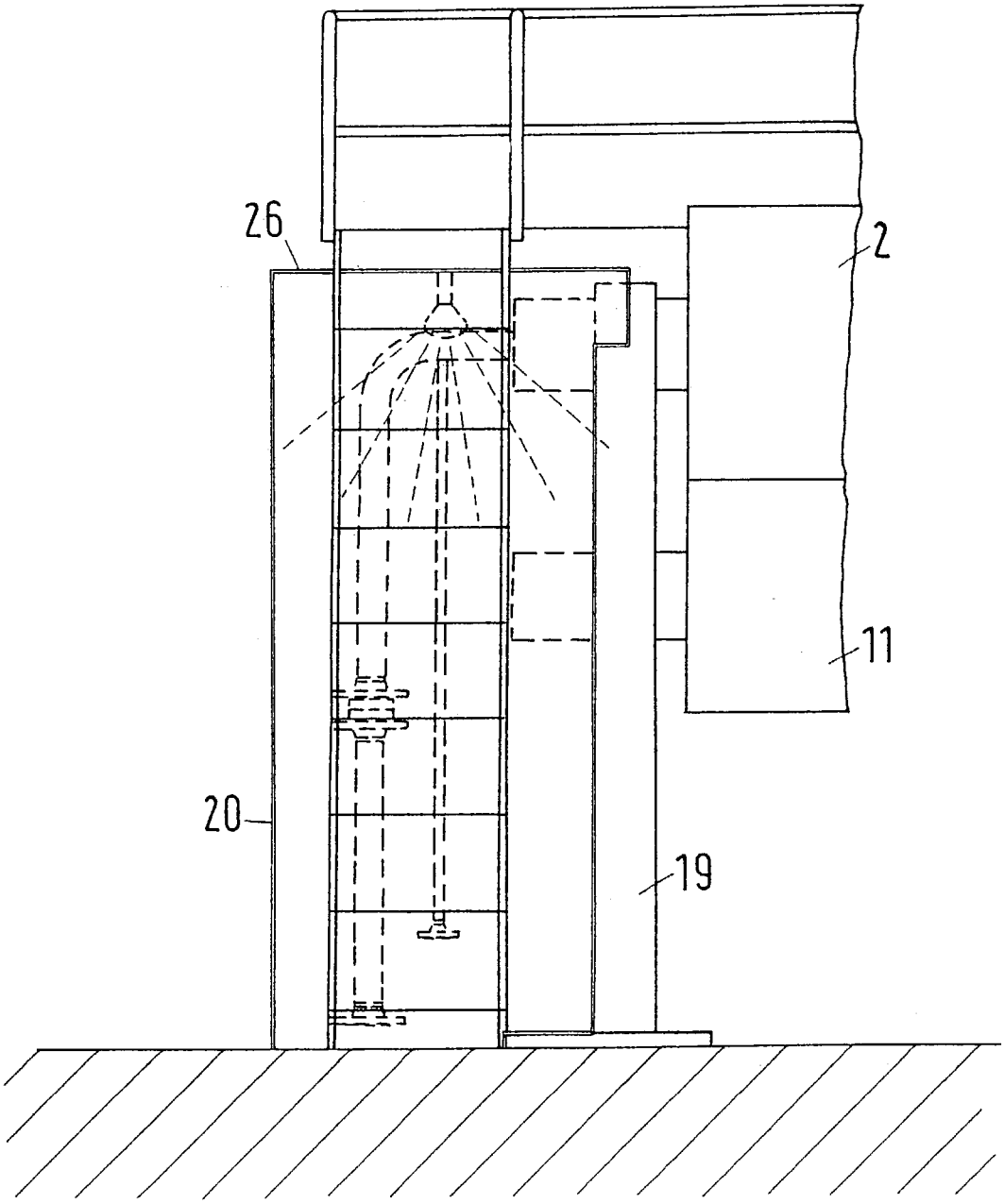
FIG. 7 illustrates a diagrammatic front view of a part of the calender depicted in FIG. 6.

FIGS. 6 and 7 show that such a housing can be provided even with a 2-roll calender. The same parts are labeled here with the same reference numbers. It is shown that the roll stack of rolls 2 and 11 (i.e., top roll 2 and bottom roll 11) is arranged essentially vertically. However, with a 2-roll calender it is also possible to tilt the roll stack with respect to the vertical.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A calender comprising:

at least one supporting bracket;

a roll stack having at least two rolls, wherein at least one axial end of each of said at least two rolls are supported by said at least one supporting bracket;

a connection arrangement comprising a fluid connection coupled to at least one of said at least two rolls and a drive connection coupled to at least one of said at least two rolls; and a closed housing including a partition wall formed between said connection arrangement and working areas of the rolls.

2. The calender in accordance with claim 1, wherein said roll stack is oriented to be tilted relative to the gravitational direction.

3. The calender in accordance with claim 1, wherein said at least two rolls comprises at least two end rolls and a plurality of center rolls arranged between said at least two end rolls, and said plurality of center rolls are supported on levers.

4. The calender in accordance with claim 3, further comprising protective cushions arranged between neighboring levers.

5. The calender in accordance with claim 4, wherein said protective cushions fill an area between neighboring levers.

6. A calender comprising:

at least one supporting bracket;

a roll stack having at least two rolls, wherein at least one axial end of each of said at least two rolls are supported by said at least one supporting bracket;

a connection arrangement comprising a fluid connection coupled to at least one of said at least two rolls and a drive connection coupled to at least one of said at least two rolls; and a closed housing including a partition wall formed between said connection arrangement and working areas of the rolls;

wherein said closed housing comprises said at least one supporting bracket.

7. A calender comprising:

at least one supporting bracket;

a roll stack having at least two rolls, wherein at least one axial end of each of said at least two rolls are supported by said at least one supporting bracket;

a connection arrangement comprising a fluid connection coupled to at least one of said at least two rolls and a drive connection coupled to at least one of said at least two rolls;

a closed housing including a partition wall formed between said connection arrangement and working areas of the rolls; and an extinguishing agent feed arranged within said closed housing within a region of said connection arrangement.

8. A calender comprising:

at least one supporting bracket;

a roll stack having at least two rolls, wherein at least one axial end of each of said at least two rolls are supported by said at least one supporting bracket;

a connection arrangement comprising a fluid connection coupled to at least one of said at least two rolls and a drive connection coupled to at least one of said at least two rolls; and a closed housing arranged to enclose said connection arrangement, wherein said roll stack is oriented to be tilted relative to a gravitational direction, and wherein said closed housing comprises a cover tilted at an angle that corresponds to the tilt of said roll stack.

9. The calender in accordance with claim 8, wherein said cover comprises a step arrangement.

10. The calender in accordance with claim 8, wherein said cover is displaceable from said closed housing to thereby open said closed housing.

11. The calender in accordance with claim 10, wherein said cover is displaceable in an axial direction of said at least two rolls.

12. The calender in accordance with claim 10, further comprising rails, wherein said cover is displaceably supported on said rails.

13. The calender in accordance with claim 12, wherein said rails are arranged outside a cross section of said roll stack and extend over a width of said calender.

14. The calender in accordance with claim 10, wherein a sealing arrangement is coupled to said cover, whereby, when closed, said closed housing can be sealed.

15. The calender in accordance with claim 14, wherein said sealing arrangement comprises a pressurizable seal.

16. A calender comprising:

a roll stack comprising a plurality of rolls; and a closed housing including a partition wall formed between at least one axial end of said plurality of rolls and working areas of said plurality of rolls;

wherein said closed housing comprises a support bracket arranged to support said at least one axial end of said plurality of rolls.

17. The calender in accordance with claim 16, wherein said at least a portion of said plurality of rolls comprises roll bearings on said at least one axial end of said plurality of rolls.

18. The calender in accordance with claim 16, wherein said at least a portion of said plurality of rolls comprises at least one of a drive connection coupled to one of said plurality of rolls and a fluid connection coupled to one of said plurality of rolls.

19. The calender in accordance with claim 16, said closed housing comprising a displaceable cover.

20. The calender in accordance with claim 16, wherein said plurality of rolls is two rolls arranged to form a single nip.

21. A calender comprising:

a roll stack comprising a plurality of rolls;

a closed housing arranged at at least one axial end of said plurality of rolls to enclose at least a portion of said plurality of rolls, said closed housing comprising a displaceable cover; and rails arranged parallel to said rolls, wherein said cover is axially displaceably supported on said rails.

22. The calender in accordance with claim 21, wherein said rails extend over a width of said calender.

23. A calender comprising:

a roll stack of the calender comprising a plurality of rolls; and a closed housing including a partition wall formed between at least one axial end of said plurality of rolls and working areas of said plurality of rolls;

said housing comprising a displaceable cover;

wherein said cover is sealingly couplable to said housing through a pressurizable seal.

24. A calender comprising:

a roll stack of the calender comprising a plurality of rolls; and a closed housing including a partition wall formed between at least one axial end of said plurality of rolls and working areas of said plurality of rolls;

wherein said plurality of rolls comprises at least two end rolls and a plurality of center rolls arranged between said at least two end rolls, and said plurality of center rolls are supported on levers.

25. The calender in accordance with claim 24, further comprising protective cushions arranged between neighboring levers.

26. The calender in accordance with claim 25, wherein said protective cushions fill an area between neighboring levers.

* * * * *